US007969457B2

(12) United States Patent
Sahud

(10) Patent No.: US 7,969,457 B2
(45) Date of Patent: Jun. 28, 2011

(54) METHOD AND APPARATUS FOR MARKING A DOCUMENT

(75) Inventor: Andrew Graham Sahud, Pittsburgh, PA (US)

(73) Assignee: Allegheny-Singer Research Institute, Pittsburgh, PA (US)

( * ) Notice: Subject to any disclaimer, the term of this patent is extended or adjusted under 35 U.S.C. 154(b) by 1075 days.

(21) Appl. No.: 11/731,846

(22) Filed: Apr. 2, 2007

(65) Prior Publication Data

US 2008/0239057 A1 Oct. 2, 2008

(51) Int. Cl.
*B41J 2/315* (2006.01)

(52) U.S. Cl. ..... 347/171

(58) Field of Classification Search ..... 347/171, 347/172, 214, 215, 217, 218, 221, 222; 400/120.01, 400/120.02; 705/408; 283/71
See application file for complete search history.

(56) References Cited

U.S. PATENT DOCUMENTS 5,848,401 A * 12/1998 Goldberg et al. ..... 705/408
5,997,194 A * 12/1999 Nunokawa et al. ..... 400/120.01

* cited by examiner

*Primary Examiner* — K. Feggins
(74) *Attorney, Agent, or Firm* — Pepper Hamilton LLP

(57) ABSTRACT

An apparatus for marking a document includes a housing configured to be handheld having a display. The housing has an input element in communication with the display through which information to be marked on the document is entered and which appears on the display. The housing has a clock which keeps time and date. The housing has a stamp. The housing has an activation element which when activated causes the stamp to mark the time and date and information on the document. A method, for marking a document includes the steps of entering information into an input element of a housing configured to be handheld. There is the step of displaying the information on a display of the housing in communication with the input element. There is the step of keeping track of time and date with a clock of the housing. There is the step of activating an activation element of the housing which causes a stamp to mark the time and date and information on the document.

17 Claims, 5 Drawing Sheets

METHOD AND APPARATUS FOR MARKING A DOCUMENT

FIELD OF THE INVENTION

The present invention is related to marking time and date and information on a document with a stamp. More specifically, the present invention is related to marking time and date and information, such as identity of a user, on a document with a stamp that is a thermal transfer printer which uses a clock and a input element to introduce the information.

BACKGROUND OF THE INVENTION

Many occupations require that signed documents include a recorded date, time, and other personal identifying information. Currently, available handheld stamps require the application of ink. Such stamps typically include: Name, Telephone and/or Pager Number, but the date and time are excluded. For example, hospital employees (including health care providers and other ancillary staff) are required to indicate their name, date, time, and pager when documenting within the medical record. This necessary standard, to include the aforementioned personal identifying information, is reflective of the fact that medical records are indeed legal documents. There is large demand for such a handheld device. Such a tool would serve an unmet need in the arena of legal documents which would include items such as: medical documents, subpoenas, summons, court documents, and others.

The current handheld stamping devices vary in size, shape, and mechanism, but ultimately all are restricted to delivering data which is fixed. Most of these stamps are incapable of recording the time and date. This deficiency results in unnecessary obstacles for legal documentation.

Stamps utilizing ink pads have changed very little in the past 50 years. While the original rubber stamp concept has expanded to include self inking features or customized images, most date stamps require manual setting each day and do not include the time recording. A few items available on the market include a products made by DYMO Corp. called an "Electronic Date/time Stamper" which uses a small ink roller. This device does not allow for custom messages (has seven optional preformatted messages to accompany the time and date), is slow to print, and requires precision and dexterity to exact a quality stamp. The Reiner speed i Jet 798 Date stamp utilizes non-contact ink jet printing, is handheld and can print more easily on any surface (smooth or uneven) but requires connection to PC to program the printout and prints variably based on one's ability to coordinate holding the device while it prints. Hence, printout is variable and requires dexterity to create linear documents with equally sized letters (which change depending on how slowly or quickly on moves the device). The Reiner speed I Jet has some desirable features but carries the same disadvantages of other inkjet printers, namely, ink bleeding, easy bleeding and running, clogging of printer heads, and expensive replacement cartridges. The apparatus is unique in that it utilized the thermal transfer method, operates more like a traditional stamp (prints onto paper after placing the device directly onto the surface). The apparatus does not require USB connection and programming to a PC. There is variability to the stamp print aside from the date and time component, and the device does not require expensive inkjet replacement cartridges.

The apparatus is designed as a modern stamp or an extension of the existing concept of the well known rubber stamp. More specifically, it behaves like a stamp and not like a hand held printer, is self-contained and functions independent of accessories. There is no existing product which fills this current need.

BRIEF SUMMARY OF THE INVENTION

The present invention pertains to an apparatus for marking a document. The apparatus comprises a housing configured to be handheld having a display. The housing has an input element in communication with the display through which information to be marked on the document is entered and which appears on the display. The housing has a clock which keeps time and date. The housing has a stamp. The housing has an activation element which when activated causes the stamp to mark the time and date and information on the document.

The present invention pertains to a method for marking a document. The method comprising the steps of entering information into an input element of a housing configured to be handheld. There is the step of displaying the information on a display of the housing in communication with the input element. There is the step of keeping track of time and date with a clock of the housing. There is the step of activating an activation element of the housing which causes a stamp to mark the time and date and information on the document.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
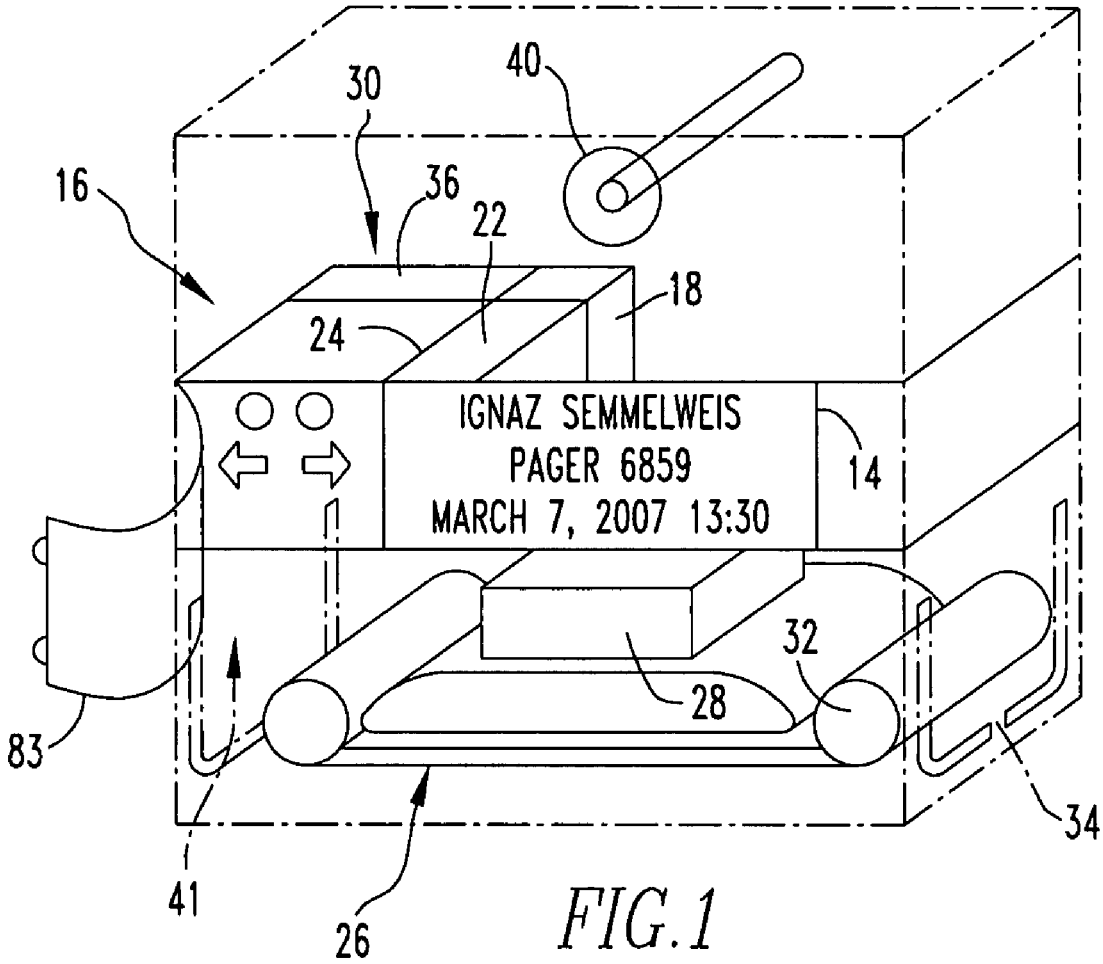
FIG. 1 is a schematic representation of the apparatus of the present invention.
Figure 3:
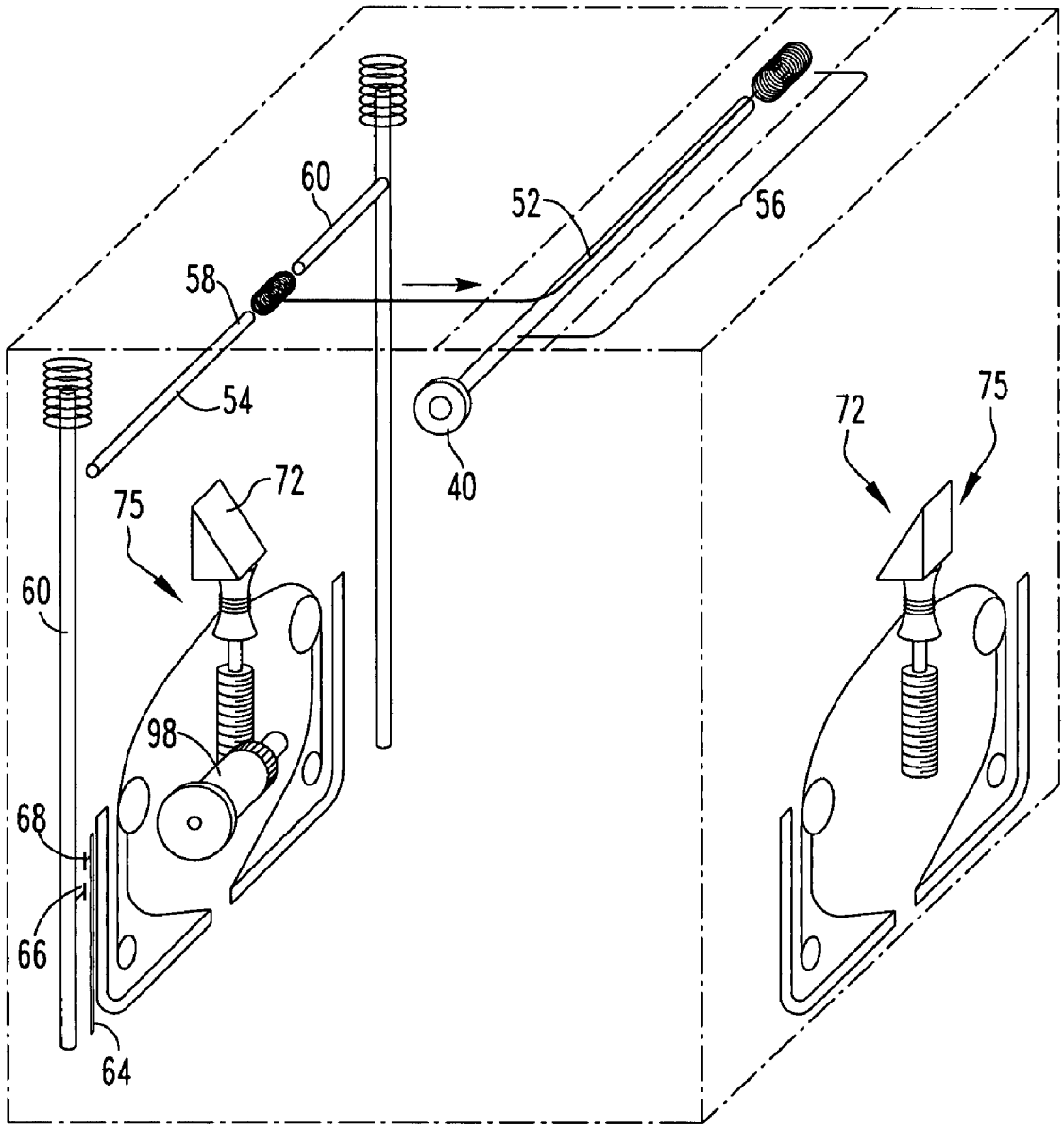
FIG. 3 is a schematic representation of an internal portion of the apparatus.
Figure 4:
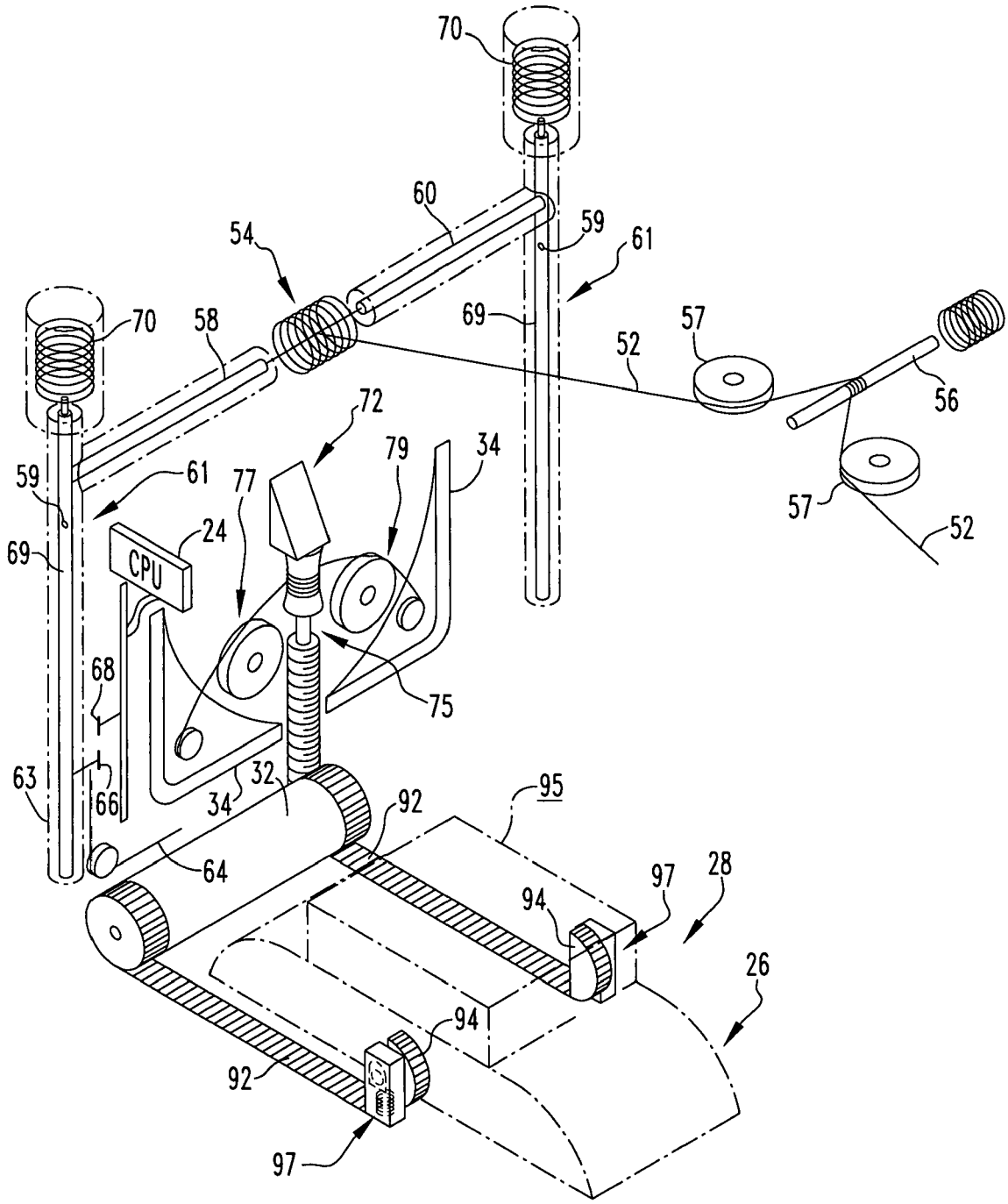
FIG. 4 is a schematic representation of the internal portion of the apparatus.

Referring now to the drawings wherein like reference numerals refer to similar or identical parts throughout the several views, and more specifically to FIGS. 1, 3 and 4 thereof, there is shown an apparatus 10 for marking a document. The apparatus 10 comprises a housing 12 configured to be handheld having a display 14. The housing 12 has an input element 16 in communication with the display 14 through which information to be marked on the document is entered and which appears on the display 14. The housing 12 has a clock 18 which keeps time and date. The housing 12 has a stamp 26. The housing 12 has an activation element 20 which when activated causes the stamp 26 to mark the time and date and information on the document.

Preferably, the housing 12 has a memory 22 which stores the information inputted via the input element 16, the memory 22 in communication with the input element 16. The housing 12 preferably has a CPU 24 in communication with the memory 22 and the clock 18 that transfers the information from the memory 22 to the stamp 26. Preferably, the stamp 26 includes a thermal transfer printer 28. The housing 12 preferably has a power source 30 in communication with the printer 28. Preferably, the printer 28 includes a ribbon 32, a portion, of which is melted by the printer 28 onto the document which marks the document with the information and the date and the time.

Figure 2:
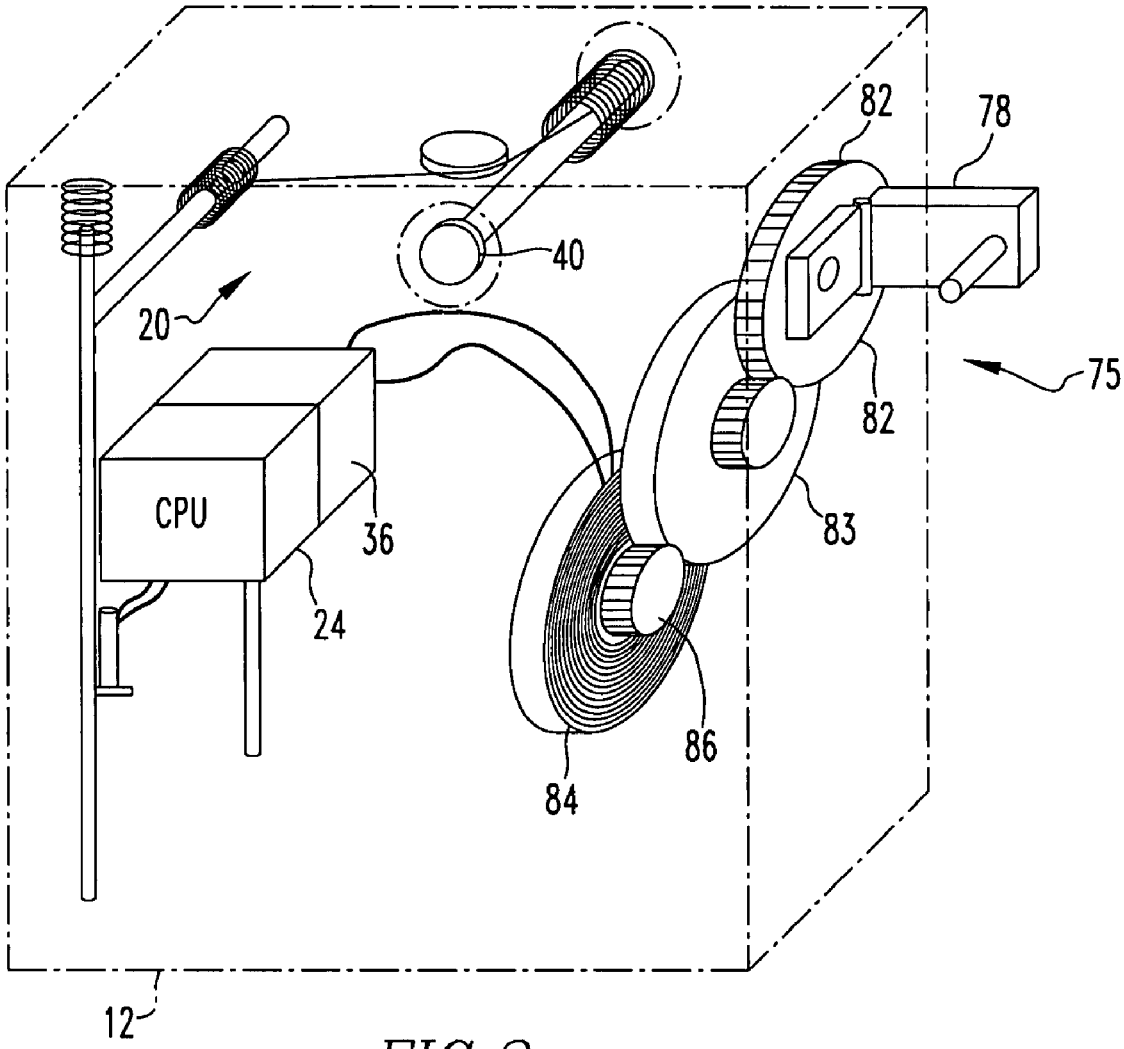
FIG. 2 is a schematic representation of the apparatus with a self-powered component.

When the activation element 20 is activated, the printer 28 is preferably caused to heat the portion of the ribbon 32. Preferably, the housing 12 has a protective cover 34 on the stamp 26 which retracts from the stamp 26, exposing the stamp 26, when the activation element 20 is activated. The power element preferably includes a battery 36. Alternatively, the power element is a self-powered element 38, as shown in FIG. 2. The activation element 20 preferably includes an activation button 40. Preferably, the ribbon 32 is composed of wax or a wax resin.

The present invention pertains to a method for marking a document. The method comprising the steps of entering information into an input element 16 of a housing 12 configured to be handheld. There is the step of displaying the information on a display 14 of the housing 12 in communication with the input element 16. There is the step of keeping track of time and date with a clock 18 of the housing 12. There is the step of activating an activation element 20 of the housing 12 which causes a stamp 26 to mark the time and date and information on the document.

Preferably, there is the step of storing the information inputted via the input element 16 into a memory 22 of the housing 12 in communication with the input element 16. There is preferably the step of transferring the information from the memory 22 and the time and the date to the stamp 26 with a CPU 24 of the housing 12 in communication with the memory 22 and the clock 18. Preferably, the activating step includes the step of activating the activation element 20 which causes a thermal transfer printer 28 to mark the time and date and information on the document. There is preferably the step of heating a portion of a ribbon 32 of the printer 28, causing the portion to melt and mark the document with the information in the time and the date. Preferably, the activating step includes the step of pushing an activation button 40.

In the operation of the preferred embodiment, a handheld device approximately 2½ inches tall, 1 inch wide and 1 inch deep, which can be carried, incorporates a thermal transfer printer 28 to allow data to be transferred to the document being stamped. Thermal transfer printers 28 are similar to direct thermal printers, which use a heating mechanism to create an image on special thermochromic paper. This mechanism is commonly used for label making devices, but is most widely utilized for printing credit card and store receipts. For the apparatus 10, it is important to utilize a technology that would not require special paper, in that, the key feature of such a product is a mechanism which allows one to directly stamp onto the paper (the unique document being stamped). As such, the thermal transfer printer 28 is suitable for this device.

Thermal transfer printers 28 operate by melting a coating of ribbon 32 (made up of different waxes or wax-resins) directly onto the paper or surface being used. The ribbon 32 is heated by a thermal element such that the melted substance is then transferred to the paper from the ribbon 32. In the context of this invention, the apparatus 10 only requires a small display 14 (LCD or other) with push buttons 41 of a keypad to manually input the personal identification information (Name, Pager Number, Telephone Number, etc.), the user wished to have issued along with the automatic and obligate recording of the date and time which is incorporated into all stamping events. An automatic clock 18 incorporated into the apparatus 10 enables the recording of the date and time with each use of the stamp 26. Clock 18 time and date could be set using the same small screen and push buttons 41 featured earlier (i.e. one button to advance through the alphabet and through numbers 0 through 9, the second button to record the character/number and advance to the next space). The date and time automatically accompany the other personal information stored. The apparatus 10 requires limited memory 22 capacity (for approximately 50 characters), would be limited to black colored print, and would not require advanced detailed resolution. A CPU 24 serves to link the data stored in memory 22 to the thermal transfer printing mechanism.

The apparatus 10 incorporates a protective cover 34 on the stamp 26 which would become exposed subsequent to pushing the activating button 40 (which results in operation of the vertical tertiary leg system 61, resulting in the juxtaposition of the leg sensor 66 to the internally housed sensor 68). Hence, the alignment of the leg sensor 66 with the internally housed sensor 68 would occur when the activating button 40 is pressed. Pressing the activating button 40 would then expose the stamp 26, causing the heating of the thermal element involved in the thermal transfer, and would require the external input of a power source 30 such as batteries or other.

The apparatus 10 could incorporate a self powered component generating energy by using a crank mechanism detailed below, as shown in FIG. 2. This feature would obviate the need for battery 36 replacement. The principle used implicates the use of the Faraday principle wherein a magnet is moved or spun in the context of a coil of wire structure to generate a current utilized to charge a rechargeable battery 36.

The apparatus 10 incorporates a spring loaded push button 40 on its front, above the area of the LCD display 14, as shown in FIGS. 3 and 4. When this button 40 is pushed, attachment cords 52 are retracted with the movement of the primary spring loaded piston column 56, which in turn releases a secondary spring loaded column 54 parallel to the primary spring loaded piston column 56 at both lateral aspects of the housing 12. The attachment cords 52 are stabilized by pulley wheels 57 situated between the primary spring loaded piston column 56 and the lateral spring loaded piston column 54. The secondary spring loaded piston column 54 has front and back pistons 58, 60 which are sustained in position in holes 59 of legs 69 (which defaults to keep pressure outwards away from the primary spring loaded column 54) until the push button 40 is engaged, thereby causing the retraction of the attachment cord 52, and the retraction of the secondary spring loaded piston column 54 out of the holes 59. This action then causes a tertiary piston mechanism 61 (in the four vertical corners of the housing 12) which are also spring loaded (by leg springs 70), and when released, the lateral spring loaded column 54 contracts and moves out of a hole at the top of each leg of the tertiary piston mechanism 61, causes the extension of four descended legs 69 (so that the "engaged pivot" on the vertical leg 69 is secured in place with the lateral piston column 54 at the base of the housing 12).

The user then presses down on the top portion of the housing 12 causing the descended tertiary piston mechanism 61 to retract upwards, thereby locking the connected horizontal secondary piston column 54 by sliding into leg holes 59 (so that the "locked pivot" on the vertical leg is secured in place with the lateral piston system) and transitioning the push button 40 back to the default ready position. As the housing 12 is pressed upon in the above scenario, causing the legs 69 to retract, a spring loaded arm 64 acting to stabilize the vertical leg mechanism with hinge small enough to fit alongside the one corner leg passes up a sleeve 63 which places the sensor 66 at the upper portion of the piston opposite the other sensor 68 secured within the housing 12 of the device. This coupling of sensors signals the beginning of a stamping circuit.

Figure 5:
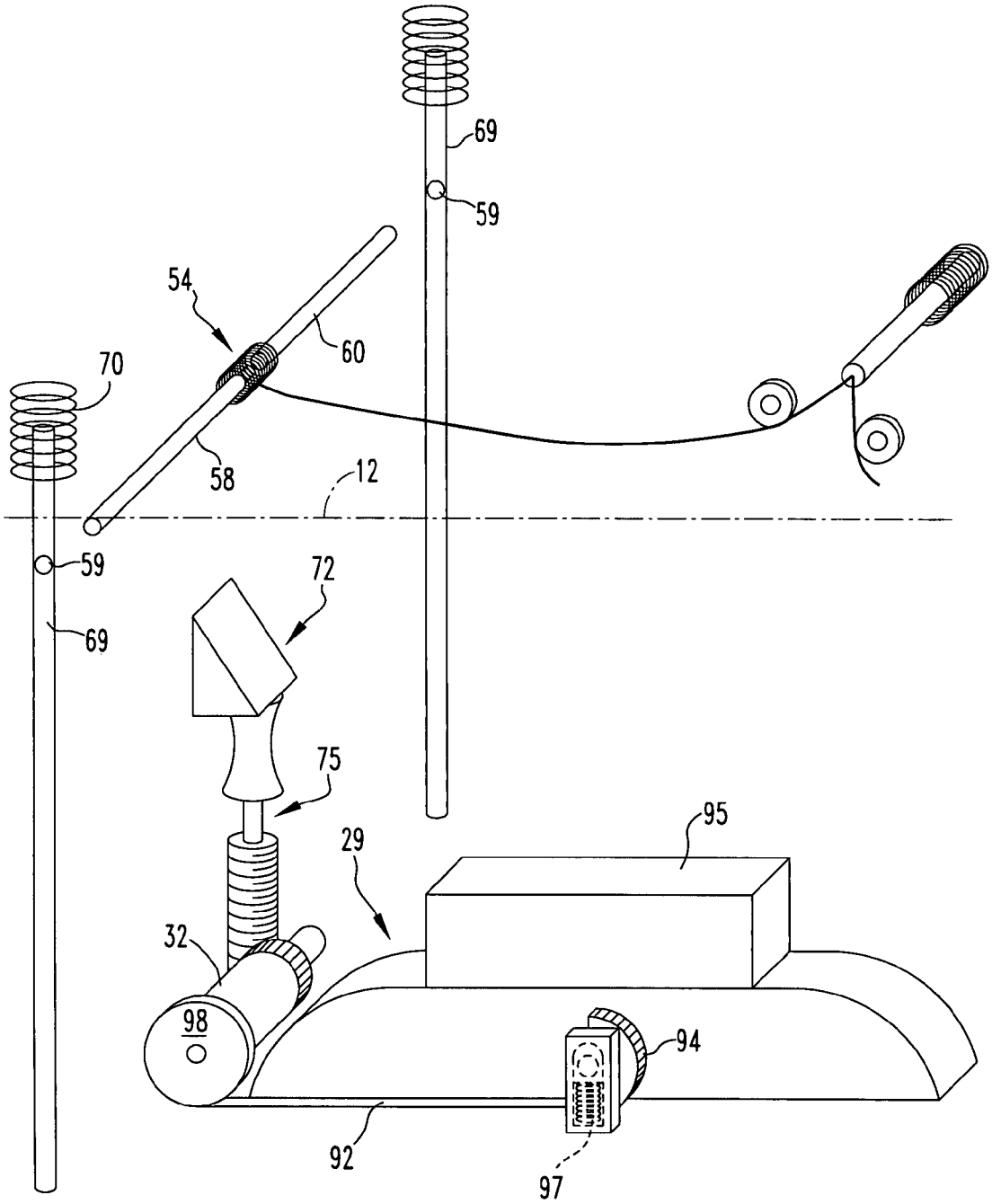
FIG. 5 is a schematic representation of a perspective side view of the apparatus.

Three simultaneous events occur with the initiation of this stamping circuit. First, a signal is sent to the CPU 24. This causes energy transfer to the heating element within the printer 28, causing the spool of ribbon 32 resin below the heating element to transfer (by melting) the stored data (displayed on the LCD readout) to the paper placed below the stamp 26. The stamping circuit also utilizes a small electric motor 72 (with threading feature to the power shaft) to power the mechanical advancement of the wax-resin ribbon 32, to cause the retraction of a flexible wire or cord 79 which is stabilized by a pulley wheel 77 on the side of the retractable door serving as an anchor between the retractable door and the vertical motor shaft 75. The wire or cord 79 winds onto the motor power shaft 75 and secondarily causes the retractable covers 34 at the base of the housing 12 to become exposed. This allows for the stamping event to occur and subsequently enables the retractable covers 34 to close once the stamping event has completed. The action of the motor 72 also causes the printer to move down and contact the paper to deposit the information, date and time on the printer, by rotating a second gear mechanism. As shown in FIG. 5, the heating element descends for the stamping event, by a second gear at the front and back ends of the spool cylinder 98 (holding the wax resin element) which have a rubber grooved tape 92 which connects to a semicircular wheel 94 attached to the sides of the heating element 95. So, as the spool cylinder 98 turns, the rubber tape 92 pulls on the semicircular wheel 94 attached to the heating element 95 which causes the heating element 95 to move down against the pressure of the spring loaded mechanism 97.

The LCD display 14 is juxtaposed to an area set back from the front face of the housing 12 covered with a plastic or rubber door 83, as shown in FIG. 1. The door can be opened or removed to expose this data entry pocket. In this area exist five buttons. One button 40 is accessed by pin or other sharp object and allows the apparatus 10 to be reset. The other buttons are mode, select, forward, and backward. When first using the apparatus 10 or when changes are to be made to the printed variable component of the stamp 26 (such as the name, pager, and telephone number) are manually inputted. Additionally, the time and date are set using these same input buttons. The apparatus 10 is powered by either battery 36 (replaceable) or ideally with a rechargeable battery 36 which can be powered both by AC adaptor or by using a crank mechanism 75 featured on the side of the housing 12.

If the crank mechanism 75 is used, as shown in FIG. 2, an arm to the crank mechanism is default positioned such that the arm 78 is flush with the wall of the housing 12. It can be pulled out and extended with a hinge mechanism. Once the crank mechanism 75 is fully extended and in the ready position, it is cranked manually. This action of cranking turns an attached wheel 82 with sprockets on the circumference. This gear wheel meshes with an intermediary wheel 83 with similar sprocket embedded periphery. These actions, in turn, engage sprockets which are a component of the axle on the adjacent fly wheel 84. The fly wheel 84 has an embedded magnet component 85 on the perimeter. This fly wheel/magnet spins around a series of copper wiring coils 86 which are the source of current generated as the magnetic fly wheel 84 rotates. The current is then sent to the rechargeable battery 36.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. An apparatus for marking a document comprising:

a housing configured to be handheld having a display, an input element in communication with the display through which information to be marked on the document is entered and which appears on the display, a clock which keeps time and date, a stamp, and an activation element which when activated causes the stamp to mark the time and date and information on the document;

wherein the housing has a memory which stores the information inputted via the input element, the memory in communication with the input element;

wherein the housing has a CPU in communication with the memory and the clock that transfers the information from the memory to the stamp;

wherein the stamp includes a thermal transfer printer;

wherein the housing has a power source in communication with the printer;

wherein the printer includes a ribbon, a portion of which is melted by the printer onto the document which marks the document with the information and the date and the time;

wherein when the activation element is activated, the printer is caused to heat the portion of the ribbon; and wherein the housing has a protective cover on the stamp which retracts from the stamp, exposing the stamp, when the activation element is activated.

2. An apparatus as described in claim 1 wherein the power element includes a battery.

3. An apparatus as described in claim 2 wherein the power element is a self-powered element.

4. An apparatus as described in claim 3 wherein the activation element includes an activation button.

5. An apparatus as described in claim 4 wherein the ribbon is composed of wax or a wax resin.

6. A method for marking a document comprising the steps of:

entering information into an input element of a housing configured to be handheld;

displaying the information on a display of the housing in communication with the input element;

keeping track of time and date with a clock of the housing; and activating an activation element of the housing which causes a stamp to mark the time and date and information on the document, wherein activating the activation element retracts a protective cover of the housing from the stamp, exposing the stamp, and wherein the stamp includes a thermal transfer printer.

7. A method as described in claim 6 including the step of storing the information inputted via the input element into a memory of the housing in communication with the input element.

8. A method as described in claim 7 including the step of transferring the information from the memory and the time and the date to the stamp with a CPU of the housing in communication with the memory and the clock.

9. A method as described in claim 8 wherein the activating step includes the step of activating the activation element which causes the thermal transfer printer to mark the time and date and information on the document.

10. A method as described in claim 9 including the step of heating a portion of a ribbon of the printer, causing the portion to melt and mark the document with the information in the time and the date.

11. A method as described in claim 10 wherein the activating step includes the step of pushing an activation button.

12. An apparatus for marking a document comprising:

a housing configured to be handheld having a display, an input element in communication with the display through which information to be marked on the document is entered and which appears on the display, a clock which keeps time and date, a stamp, and an activation element which when activated causes the stamp to mark the time and date and information on the document;

wherein the stamp includes a thermal transfer printer; and wherein the housing has a protective cover on the stamp which retracts from the stamp, exposing the stamp, when the activation element is activated.

13. The method of claim 12, wherein the housing has a memory which stores the information inputted via the input element, the memory in communication with the input element.

14. The method of claim 13, wherein the housing has a CPU in communication with the memory and the clock that transfers the information from the memory to the stamp.

15. The method of claim 12, wherein the housing has a power source in communication with the printer.

16. The method of claim 12, wherein the printer includes a ribbon, a portion of which is melted by the printer onto the document which marks the document with the information and the date and the time.

17. The method of claim 16, wherein when the activation element is activated, the printer is caused to heat the portion of the ribbon.

* * * * *